US009486695B2

(12) United States Patent
Maldonado-Castro

(10) Patent No.: US 9,486,695 B2
(45) Date of Patent: Nov. 8, 2016

(54) BILLIARD-CHECKER GAME

(76) Inventor: Juan Rafael Maldonado-Castro, Vega Alta, PR (US)

( * ) Notice: Subject to any disclaimer, the term of this patent is extended or adjusted under 35 U.S.C. 154(b) by 48 days.

(21) Appl. No.: 12/155,140

(22) Filed: May 29, 2008

(65) Prior Publication Data

US 2009/0298604 A1 Dec. 3, 2009

(51) Int. Cl.

| | |
|---|---|
| ***A63D 15/00*** | (2006.01) |
| *A63D 15/04* | (2006.01) |
| *A63D 15/20* | (2006.01) |

(52) U.S. Cl.

CPC ..... *A63D 15/00* (2013.01); *A63D 15/005* (2013.01); *A63D 15/04* (2013.01); *A63D 15/20* (2013.01)

(58) Field of Classification Search

CPC .... A63D 15/00; A63D 15/20; A63D 15/005; A63D 15/04; A63D 15/10; A63D 15/006

USPC ..... 473/1, 3, 4, 9, 10, 14; 273/309

See application file for complete search history.

(56) References Cited

U.S. PATENT DOCUMENTS

| | | | | |
|---|---|---|---|---|
| 1,349,587 | A * | 8/1920 | Smith et al. | 273/126 R |
| 3,428,322 | A * | 2/1969 | Herbert | 473/18 |
| 5,716,284 | A * | 2/1998 | Maldonado | 473/5 |
| 6,926,278 | B2 * | 8/2005 | Bibi | 273/309 |

* cited by examiner

*Primary Examiner* — Mitra Aryanpour

(74) *Attorney, Agent, or Firm* — Eugenio J. Torres-Oyola; Victor Rodriguez-Reyes; Ferraiuoli LLC

(57) ABSTRACT

A playing surface with a rectangular configuration having a pair of long edges and a pair of short edges formed therebetween having a plurality of rows of divots, each row of divots being offset from an adjacent row wherein the divots define a multiplicity of triangles, a plurality of semicircular cutouts formed along the edges thereof and two triangular positions in its center for placing 15 balls. A ball collection assembly including a hollow rectilinear periphery integrally formed about the edges of the playing surface and further extending upwardly and downwardly therefrom with the periphery having a channel formed therein, a plurality of semicircular cutouts formed contiguously with the cut outs of the playing surface to define vertically oriented circular bores which are in communication with the channel and further including a pair of adjacent open faces for a accessing the channel and balls during play.

4 Claims, 12 Drawing Sheets

BILLIARD-CHECKER GAME

STATEMENT REGARDING FEDERALLY SPONSORED RESEARCH AND DEVELOPMENT

N/A

RELATED APPLICATIONS

N/A

BACKGROUND OF THE INVENTION

1. Field of the Invention

The present invention is directed to a pool table and more particularly to an improved pool game which combines pool and checker features.

2. Discussion of the Background

The use of pool tables such as playing billiard is well known in the art. Recently the pool table has been combined or improved with features of other games in order to provide a versatile game. For example U.S. Pat. No. 5,716,284 to Juan R. Maldonado Castro discloses a Billiard-Checkers Game which combines features of a pool table with the game of checker. However the assembling of the pool is difficult and the game structure is restricted to certain games.

The present invention overcome the disadvantages of the related art providing a playing surface with a rectangular configuration having a pair of long edges and a pair of short edges formed therebetween having a plurality of rows of divots, each row of divots being offset from an adjacent row wherein the divots define a multiplicity of triangles, a plurality of semicircular cutouts formed along the edges thereof and two triangular positions in its center for placing 15 balls. A ball collection assembly including a hollow rectilinear periphery integrally formed about the edges of the playing surface and further extending upwardly and downwardly therefrom with the periphery having a channel formed therein, a plurality of semicircular cutouts formed contiguously with the cut outs of the playing surface to define vertically oriented circular bores which are in communication with the channel and further including a pair of adjacent open faces for a accessing the channel and balls during play.

SUMMARY OF THE INVENTION

The present invention overcomes the disadvantages of the Related Art by providing an easy to assemble billiard checker game.

In order to provide an improved and easy to assemble billiard checker game the present invention comprises a table game which combines the structure of the regular Chinese checkers with the rules of the regular billiard.

Besides the 6 pockets, the surface of the table is covered by 178 holes (divots), connected to each other by diagonal and horizontal lines. Also, the table has 2 triangular positions on its center. It requires 17 balls (marbles) as follows:

7 red balls
7 yellow balls
1 black ball
2 white balls

The 15 balls are to be positioned in one triangle on the center. There are two white holes on the table for placing the two white balls, before starting. Also the present game comprises two diagonal lines crossing the table topside and two crossing the table bottom side (black side).

The invention itself, both as to its configuration and its mode of operation will be best understood, and additional objects and advantages thereof will become apparent, by the following detailed description of a preferred embodiment taken in conjunction with the accompanying drawings.

The Applicant hereby asserts, that the disclosure of the present application may include more than one invention, and, in the event that there is more than one invention, that these inventions may be patentable and non-obvious one with respect to the other.

Further, the purpose of the accompanying abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE DRAWINGS

The accompanying drawings which are incorporated herein constitute part of the specifications and illustrate the preferred embodiments of the invention.

DESCRIPTION OF THE PREFERRED EMBODIMENT

Figure 1:
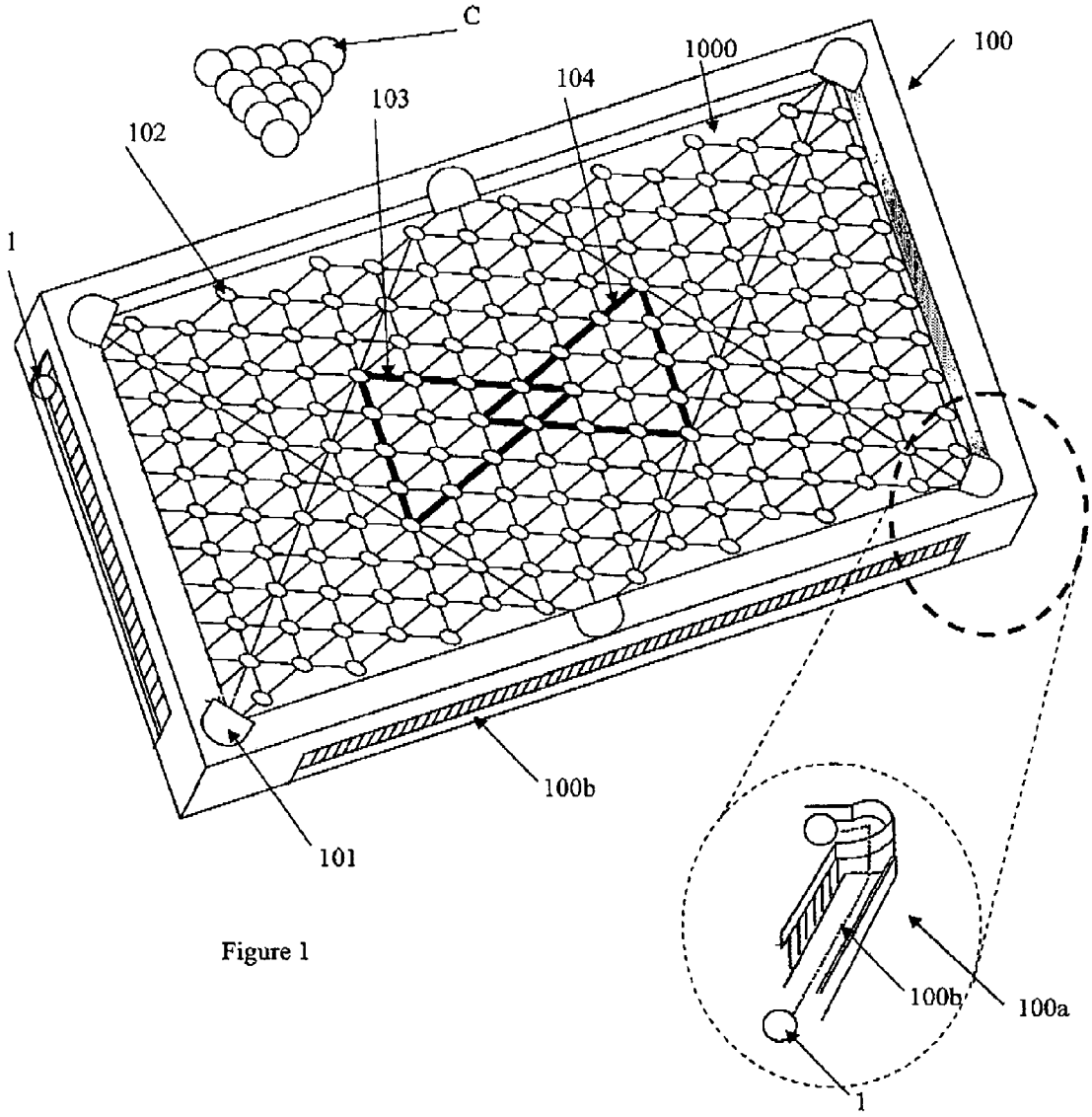
FIG. 1 is an isometric view of the present invention.

FIG. 1 shows a table game 100 which combines the structure of the regular Chinese checkers table with the rules of the regular billiard game. Several openings outside a checkers structure 1000 is placed on top of the table which are used as pockets 101. A ball collection assembly 100*a* including a hollow rectilinear periphery integrally formed about the edges of the playing table surface and further extending upwardly and downwardly therefrom with the periphery having a channel 100*b* formed therein. In addition to the 6 pockets 101, the surface on top of the table is covered with 178 holes (divots) 102, connected to each other by diagonal and horizontal lines. Also, the table has 2 triangular 103,104 positions on its center, which requires 17 colored or numbered balls (marbles) 1-5 as follows:

7 red balls 3
7 yellow balls 4
black ball 5
2 white balls 1,2

The 15 colored balls C comprises red balls 3, the yellow balls 4 and the black ball 5 are positioned in one triangle 103,104 on the center. There are two white holes 105 on table 100 for placement of the two white balls 1,2. There are also two diagonal lines crossing the table's topside D1 and two diagonal lines crossing the table's bottom side D2 (black side). In a preferred embodiment where the game surface is flat, square tokens can be used instead of the balls.

Characteristics of Billiard-Checkers

The numbered or colored balls 3-5 can be moved with the fingers along the black lines one free hole at a time, or several holes jumping over other similar balls. The cue ball 1,2 also can push a ball several free holes; and it is used to push (hit) all the balls along the free route toward a pocket. The cue ball 1,2 can be moved along the free way of all the black lines. Like the original billiard game, users can play the black-ball 5 game (in two ways). As a variation, players could play the game of 9 balls instead of the 15 balls game. Further, computer technology could be applied to this game. Several configurations may be applied to the table dimensions of the present invention. However, in a preferred embodiment the game table is rectangular in shape and it is approximately 18" long by 12" wide. The ball can be 12/16" in diameter and the game table 100 can be formed in a variety of different colors. Additionally, the game table may be provided with a rectangular shaped case for storage.

Game Instructions

In order to play the game several instructions and rules, as shown in FIGS. 2*a*-2*i*, may be applied. However, in the instant case the preferred instruction to play the game is as follows:

A player selects a group of balls usually represented by a color or a set of numbers. User/player can move the selected ball one space at a time from one hole to another using his fingers, or:

A. User/player can jump over another one of the selected balls 3-5.

B. User/player can jump over various other one of the selected balls one ball at a time in a straight or zigzag direction, along the black lines, in preparation toward a pocket 101. No matter which direction is selected, the target will always be one of the six pockets.

C. User/player selects at least one of the cue balls 1,2 and can use it to hit (push) his ball or balls for several free holes on line.

The cue balls 1,2 have the property of moving along the free way of all the black lines (free holes). Also can hit (push) a ball or several balls for several free spaces or holes along its route up to the last free hole or free access. In the alternative the user can push a ball or several balls 3-5 into the same pocket 101. Whenever the cue ball 1,2 pushes more than one ball 3-5, in a straight route, it is considered a combination play.

Figure 2A:
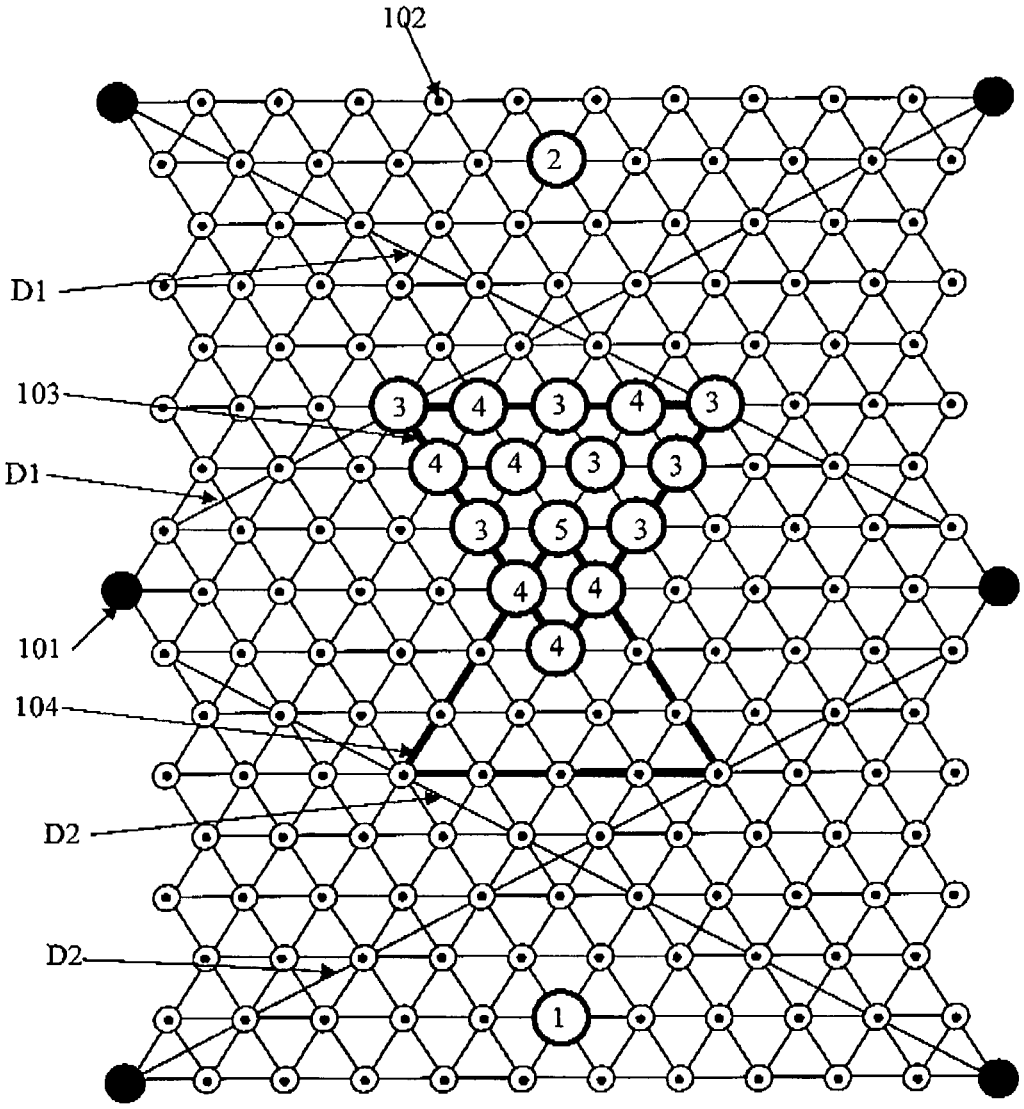
FIG. 2*a*-2*d* is a top view of the present invention.
Figure 2B:
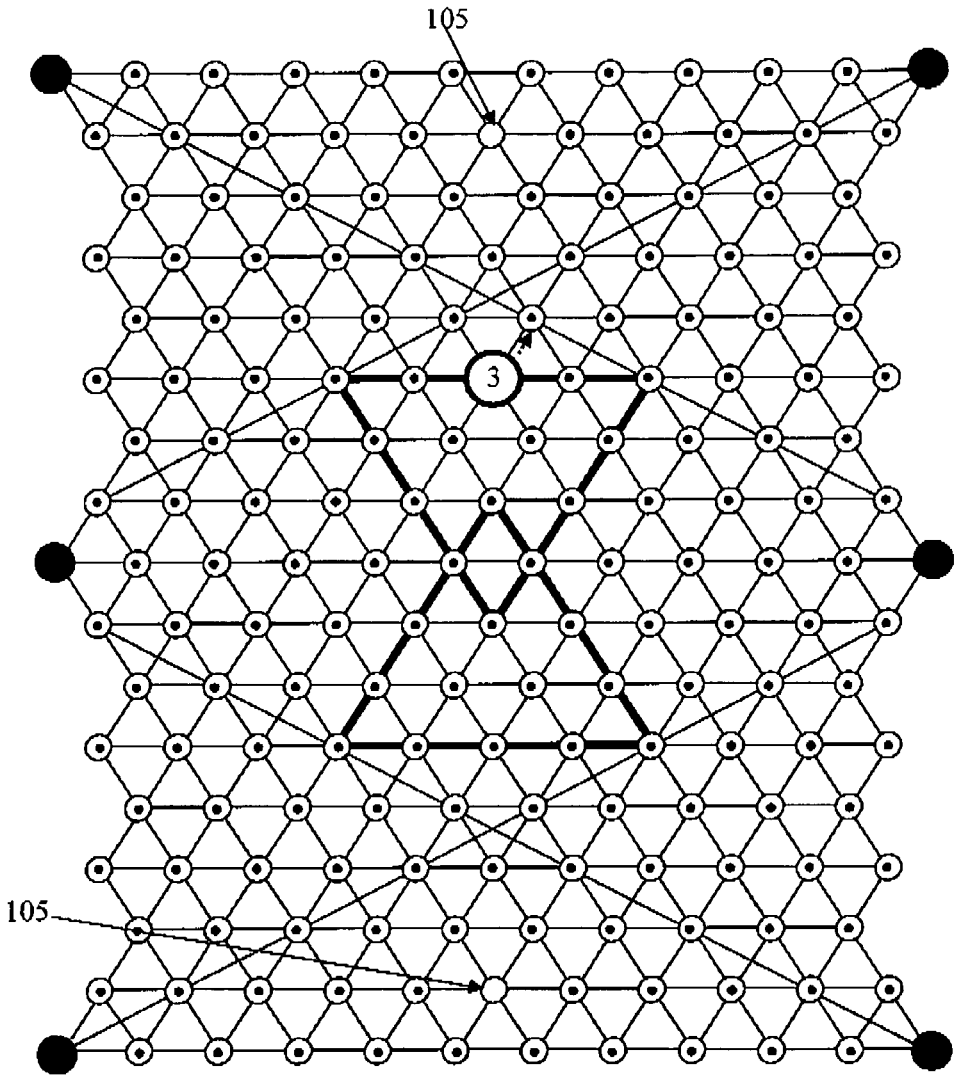
Figure 2C:
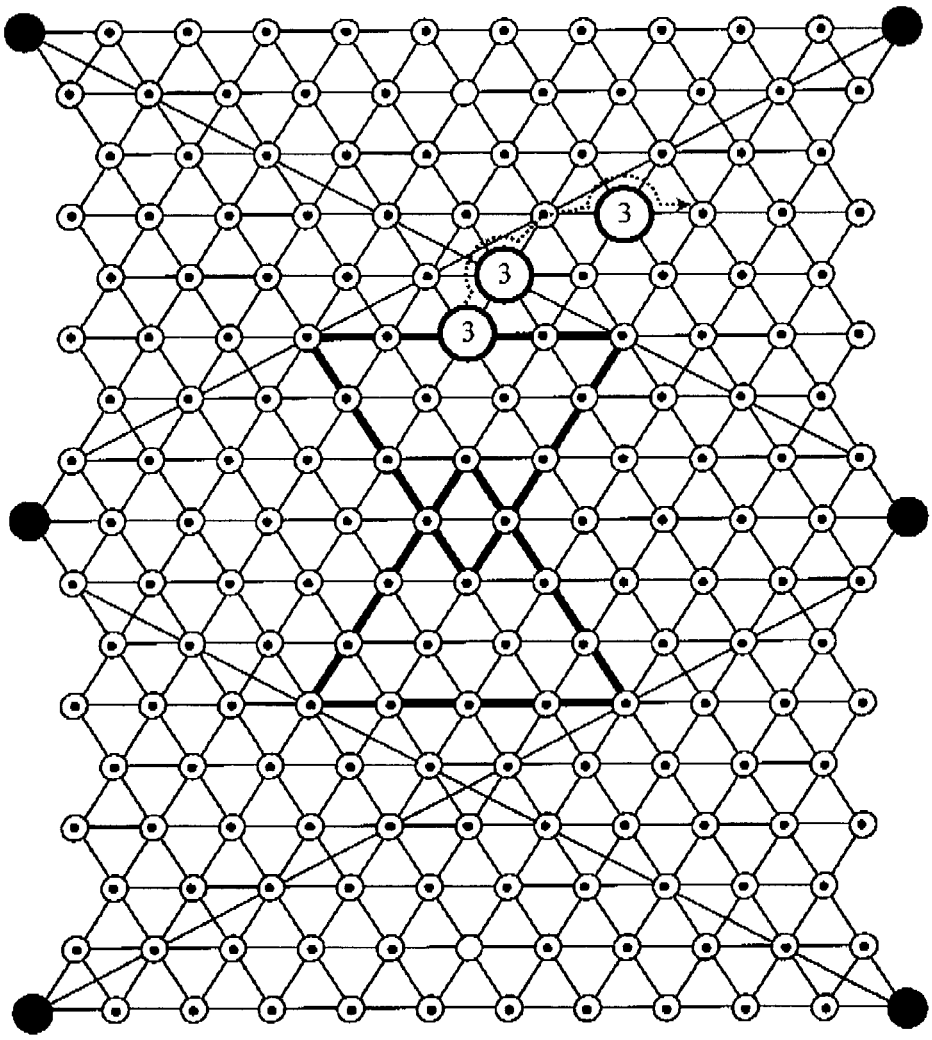
Figure 2D:
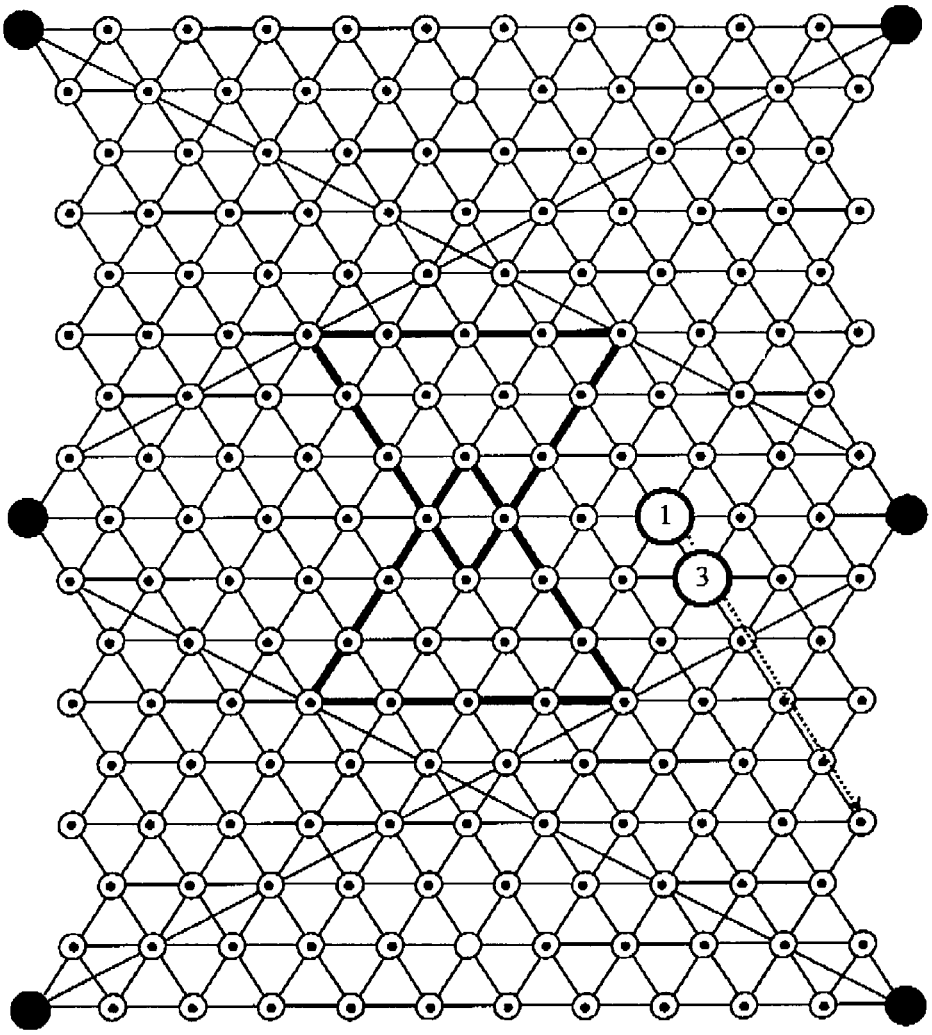
Figure 2E:
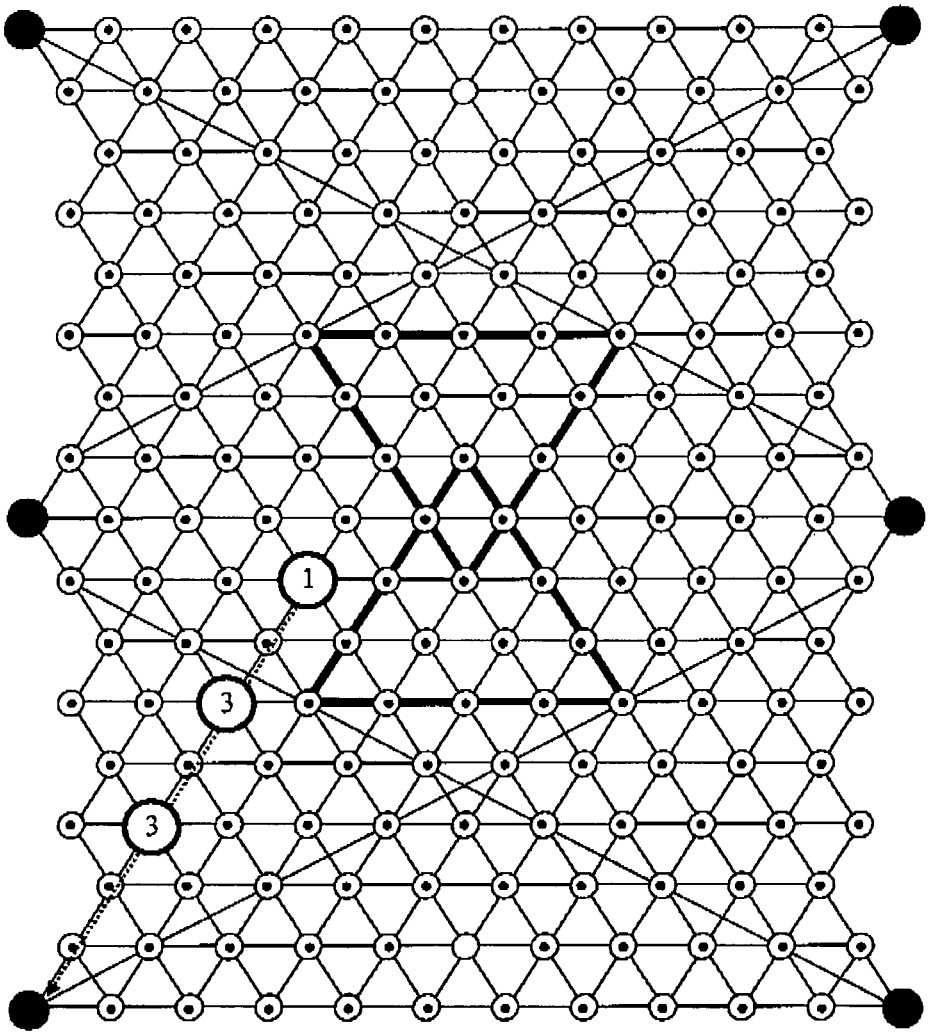
Figure 2F:
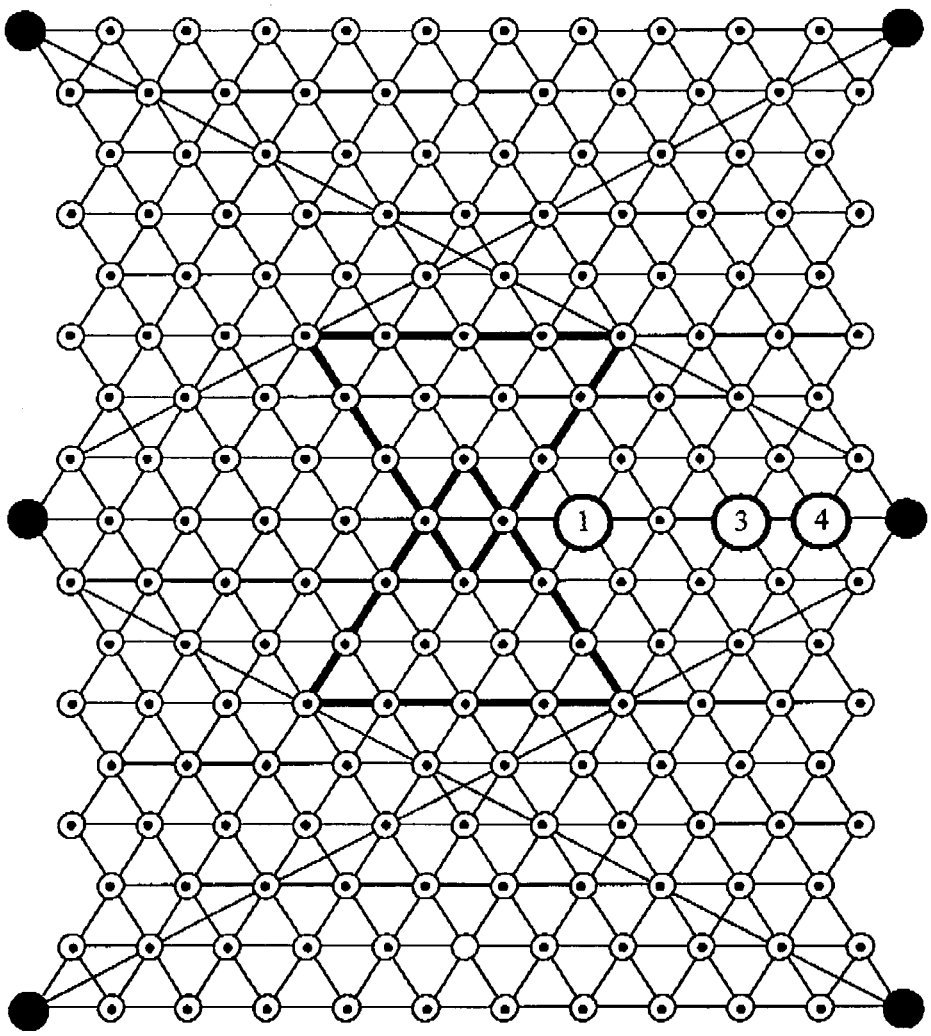
Figure 2G:
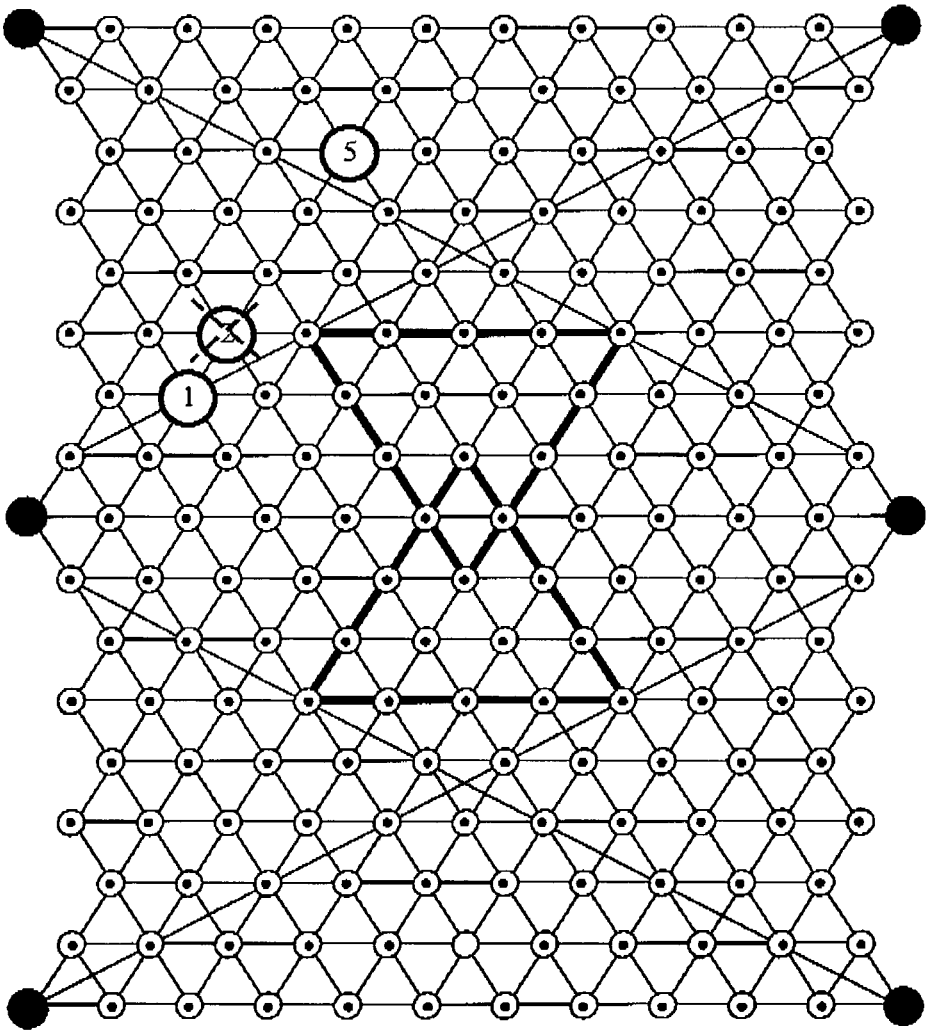
Figure 2H:
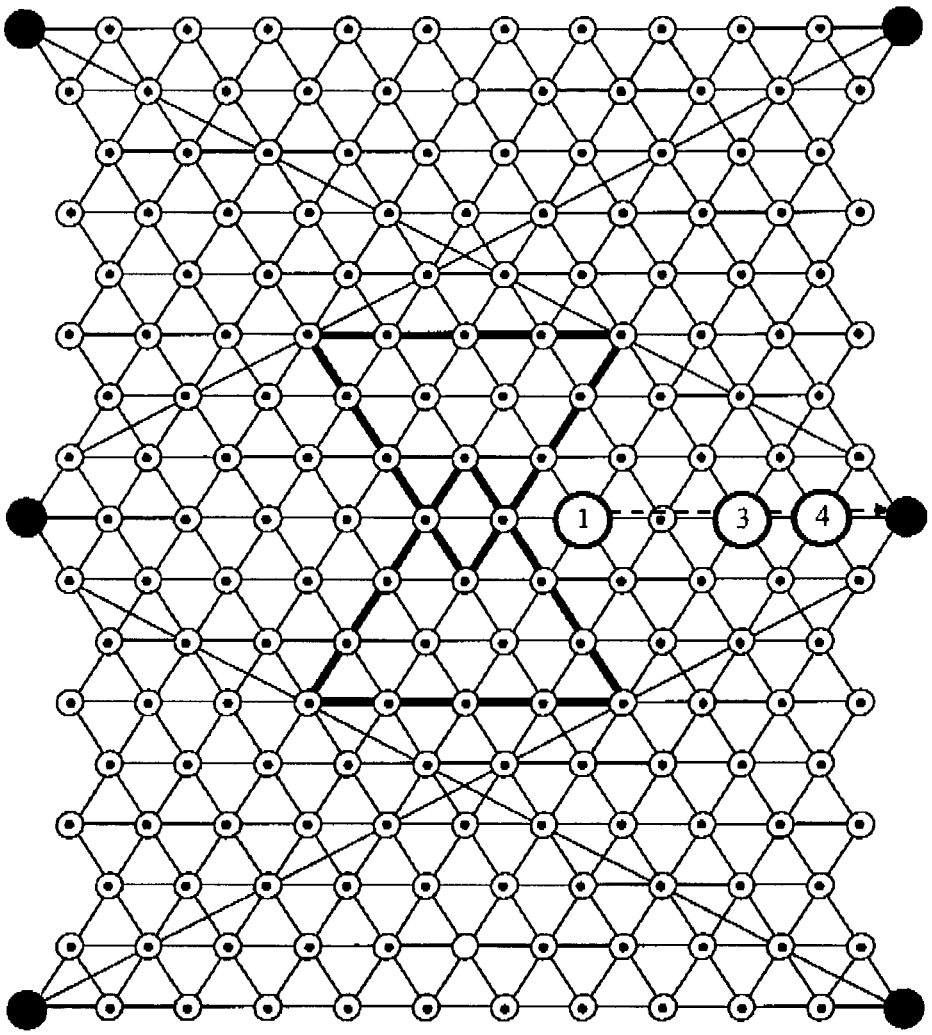
Figure 2I:
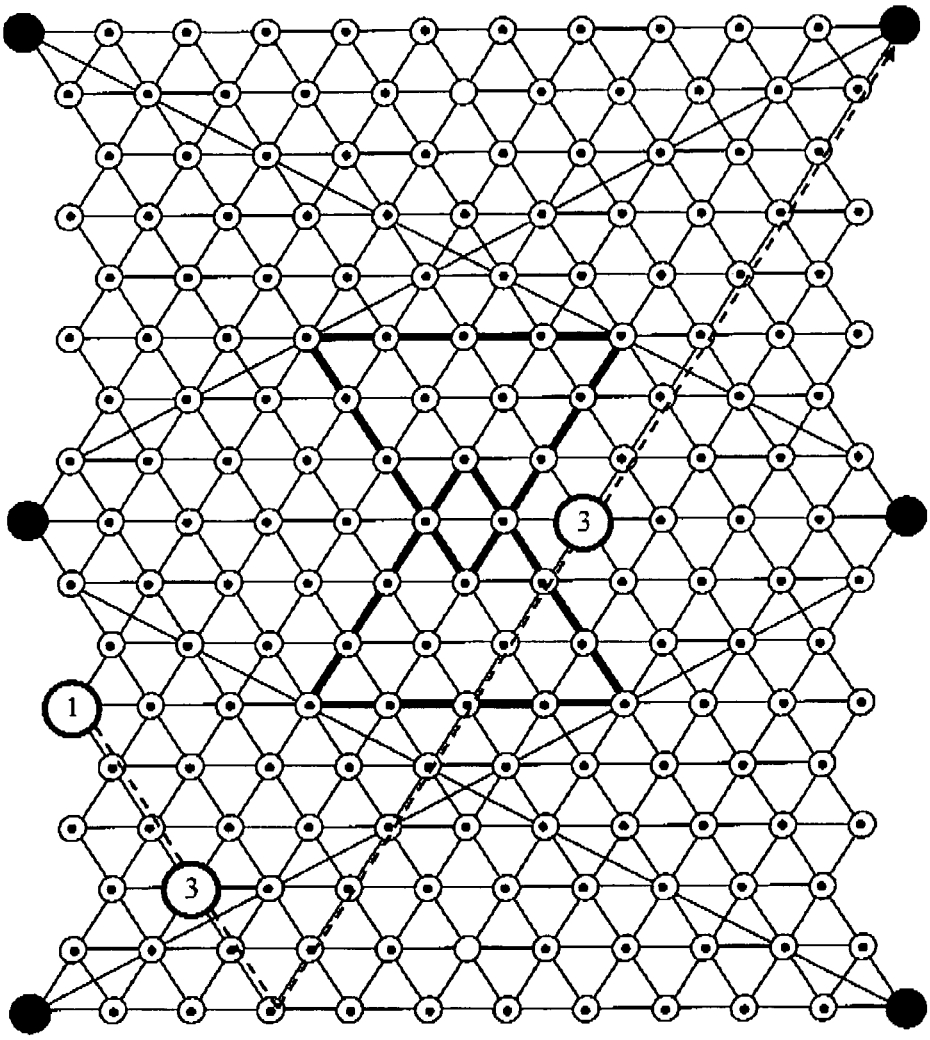

The cue ball 1,2 is always positioned in the hole of the last pushed ball, irrespective of the ball being repositioned or pocketed. The user/players can pocket a ball, only using the cue ball, and only when moving or pushing the ball #8 is the user/player not required to use his fingers. Furthermore the cue ball 1,2 cannot interfere with the other cue balls or any other ball, positioned in the same route, as shown in FIG. 2*g*.

When a player/user makes a "move toward a direction", he is unable to go back to the previous position. Additionally, when a player pockets one of the balls 3-5, then he automatically has a second turn to play again, and he may continue to play for as long as he pockets at least one ball.

Users/players can hit (push with cue ball 1,2) a ball (balls) 3-5 to the corner pockets 101 or to the center pockets 101, using the two horizontal cushions. User can only make 4 plays in the corner pockets and 4 plays in center pockets. The four wide diagonal lines D1 and D2 are used for increasing the chances to make corner pockets 101, using the two lateral cushions. However, this movement is limited to 4 plays only. Any bounce from the cushions, will only diagonally pocket the balls. In other words, if the cue ball 1,2 pushes a ball (balls) 3-5 against a cushion, that ball will bounce and goes straight to one of the pockets 101 (not for position).

Game Rules

It is important that the user understand that players e-a make their own game plays or rules but it should be according to regulated rules. In the instant case the preferred set of rules are as follows:

1. Players/Users can move their ball one space using their fingers.

2. Players/Users can move their ball one, two, or more spaces jumping over opponent's balls. For example, the move can be straight or zigzags as shown in FIGS. 2*b*-2*c*.

3. Using the cue ball 1,2, players/users can push the ball one, two, or more spaces (straight line-position) as shown in FIG. 2*d* or straight to pocket 101.

4. Using the cue ball 1,2, players/users may push two or more balls at the same time when the balls are in a cue ball's route, straight to the same pocket or the play can be for position.

5. Blocking is performed when a user places his selected ball in front of the opponent's ball. By doing so, the opponent is unable to push his ball to his selected pocket (this is whenever a player has a ball ready for pocket it). User can block only the opponent's ball one time in the game. Also the cue ball 1,2 is unable to block every ball. Further while playing with the last ball, which is usually the black ball 5, a cue ball 1,2 cannot interfere in any route between the other cue ball 1,2 and ball 5. For example, as shown in FIG. 2*g*, if both white balls are on line with the black ball (same route), the white ball in the middle has to leave.

Nevertheless, you can apply the "blocking play" against ball 5, using one of your selected balls. But here the user cannot use "Play of sacrifice", because user must push ball 5 clean (alone) to the pocket 101.

6. A special move named as "Play of sacrifice" is provided. "Play of sacrifice" is an optional play whenever user/player is blocked in his route to his pocket 101 (go over play #5). Although your opponent has blocked you, you may elect to make the play in that pocket: you first push your ball and then take the opponent's ball, in combination, to your pocket.

A. However, by doing so you will no longer have a second turn to play.

B. Only one ball of each player can be pocketed.

C. Because the blocking is possible one time, you have one chance to make this play.

7. User/player using the cue ball 1,2 may push his selected ball against a cushion in such a way that the ball bounces and goes straight toward a pocket. Also the bounced ball, will take any other ball positioned in its route to the same pocket 101 or even against the cushion.

8. The black ball 5 will stay in its hole, until one of the players pockets the last ball of his selected group. Then the user/player has to pocket ball 5 in the same pocket of his last selected group ball, and the user/player is only able to move (push) ball 5 with his cue ball 1,2.

Game Assembling

Figure 3:
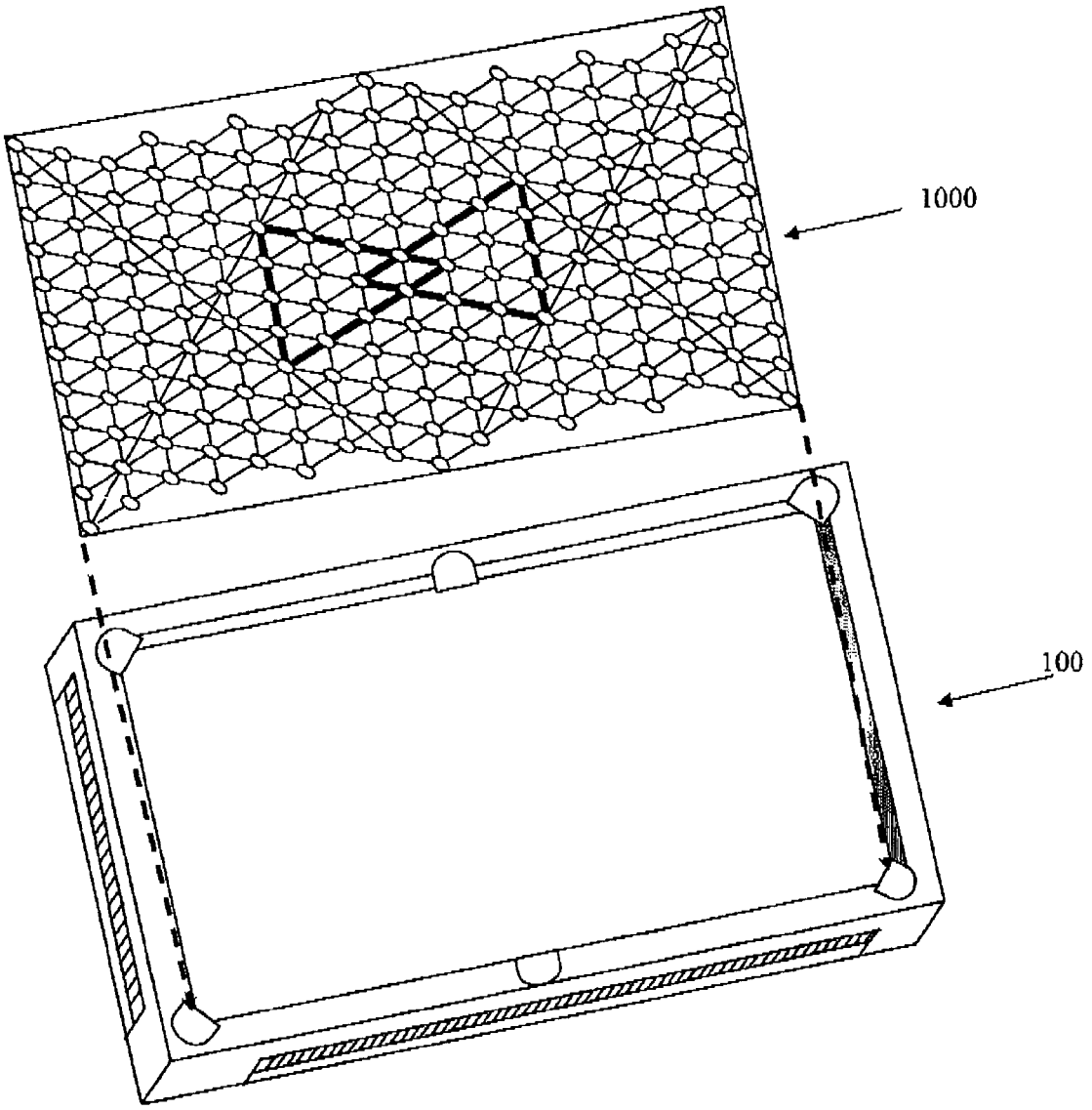
FIG. 3 shows the first format game assembly.

Besides a one piece billiard-checker table the present invention can adopt at least two different formats. The first format, as shown in FIG. 3, discloses an independent and removable surface which is composed of two parts. The first part is a regular billiard table 100 and the second part is a rectangular shaped surface formed of a plastic material, such as acrylic, with the billiard-checker structure 1000 printed on its surface, as shown in FIG. 3 and further comprising the 178 holes 102. In order to assemble the first and second parts the rectangular shaped surface is placed over the regular billiard table converting a regular billiard table into a billiard-checker table.

Figure 4:
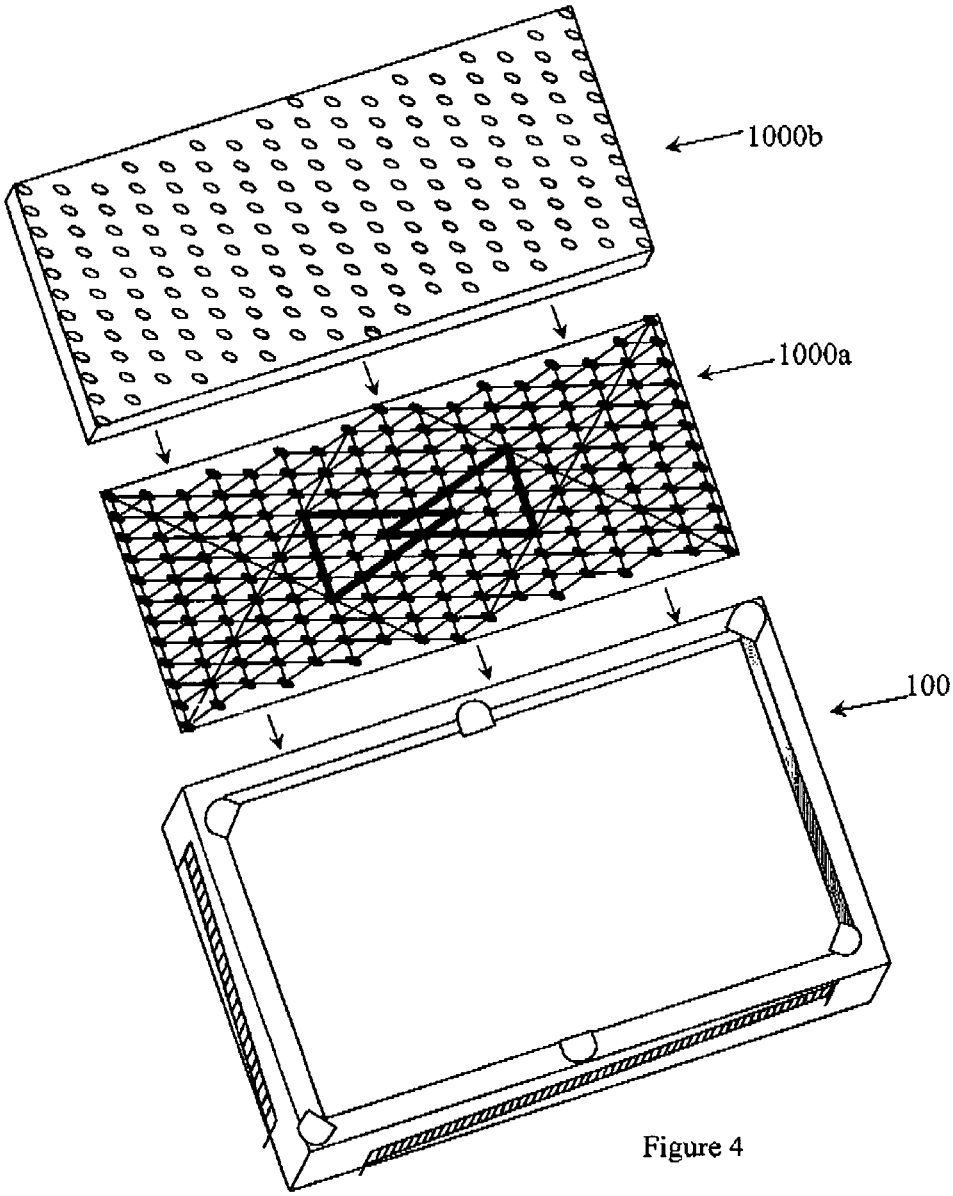
FIG. 4 shows the second format game assembly.

The second format, as shown in FIG. 4, is an independent and removable surface which comprises three parts. The first part is a regular billiard table 100, the second part is a drafted paper 1000*a* with the billiard checker structure printed on it and the third part is a rectangular shaped surface formed of plastic material such as acrylic, with the billiard-checker structure 1000*b*, as shown in FIG. 4 and further comprising the 178 holes 102. In order to assemble the parts, the drafted paper is positioned over the regular billiard table and the rectangular shaped surface is placed over said drafted paper converting the regular billiard table into a billiard-checker table.

While the invention has been described as having a preferred design, it is understood that many changes, modifications, variations and other uses and applications of the subject invention will, however, become apparent to those skilled in the art without materially departing from the novel teachings and advantages of this invention after considering this specification together with the accompanying drawings. Accordingly, all such changes, modifications, variations and other uses and applications which do not depart from the spirit and scope of the invention are deemed to be covered by this invention as defined in the following claims and their legal equivalents. In the claims, means-plus-function clauses, if any, are intended to cover the structures described herein as performing the recited function and not only structural equivalents but also equivalent structures.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present invention, as well as equivalents thereof. The details in the patents, patent applications, and publications incorporated by reference herein may be considered to be incorporable at applicant's option, into the claims during prosecution as further limitations in the claims to patentable distinguish any amended claims from any applied prior art.

The invention claimed is:

1. A pool table comprising in combination, a plurality of numbered balls;

a playing surface comprising a first surface and a second surface having a rectangular configuration, said first surface comprises a first pair of long edges and a first pair of short edges formed therebetween, a plurality of rows of divots placed on said surface, said plurality of rows of divots including a first row of divots offset from an adjacent row of divots, wherein the rows of divots define a multiplicity of triangles, and wherein part of the multiplicity of triangles is combined to form two large triangles on said first surface, said two large triangles placed in the center of said first surface for positioning said plurality of numbered balls; and a plurality of semicircular cutouts formed along the edges of said first surface;

said second surface comprises a plurality of semicircular grooves, said semicircular grooves formed and distributed on a first side of said second surface and having the same configuration as the plurality of rows of divots placed on said first surface, wherein said second surface is positioned on top of said first surface, said semicircular grooves of said second surfaces is matched up with said plurality of rows of divots of said first surface; and a ball collection assembly including a hollow rectilinear periphery integrally formed about the edges of the first playing surface and further extending upwardly and downwardly therefrom forming a channel in said hollow rectilinear periphery, said hollow rectilinear periphery including a plurality of semicircular pockets formed contiguously with the semicircular cut outs of said first playing surface to define vertically oriented circular bores which are in communication with the channel, said hollow rectilinear periphery further including a pair of adjacent open faces for allowing access to the channel during play.

2. A game table as in claim 1, wherein the plurality of balls are billiard balls.

3. A pool table as in claim 1, wherein the first surface and second surface fit inside the boundaries of a pool table top surface.

4. A pool table as in claim 1, wherein said second surface is made of a transparent material.

* * * * *